United States Patent [19]

Tanaka et al.

[11] Patent Number: 4,688,060

[45] Date of Patent: Aug. 18, 1987

[54] PRESSURE SENSITIVE MANIFOLD PAPER

[75] Inventors: Masato Tanaka, Amagasaki; Shinsuke Irii, Kobe; Tomoharu Shiozaki, Amagasaki, all of Japan

[73] Assignee: Kanzaki Paper Manufacturing Company Limited, Tokyo, Japan

[21] Appl. No.: 826,016

[22] Filed: Feb. 4, 1986

[30] Foreign Application Priority Data

Feb. 14, 1985 [JP] Japan ..... 60-29105

[51] Int. Cl.[4] ..... B41M 5/16; B41M 5/22

[52] U.S. Cl. ..... 503/214; 503/207; 503/215; 427/150; 427/152

[58] Field of Search ..... 346/214, 207, 215; 427/150-152

[56] References Cited

U.S. PATENT DOCUMENTS 4,120,518 10/1978 Baatz et al. ..... 427/150

4,125,675 11/1978 Sekiguchi et al. ..... 106/137

FOREIGN PATENT DOCUMENTS 8303078 9/1983 World Int. Prop. O. ..... 346/214

*Primary Examiner*—Bruce H. Hess

*Attorney, Agent, or Firm*—Larson and Taylor

[57] ABSTRACT

Disclosed is a pressure sensitive manifold paper prepared by coating a substrate with a coating composition containing microcapsules of polyurethane resin or polyurea resin wall film and drying the resulting coating, the pressure sensitive manifold paper being characterized in that a latex of copolymer of comonomers comprising about 10 to about 50% by weight of styrene, about 15 to about 55% by weight of butadiene, about 10 to about 40% by weight of methyl methacrylate and up to about 15% by weight of acrylonitrile is incorporated in the coating composition in an amount of about 5 to about 30% by weight (calculated as solids) based on the microcapsules (calculated as solids).

The pressure sensitive manifold paper has an adequate balance between the color forming ability and susceptibility to color smudges due to contact or friction.

10 Claims, No Drawings

PRESSURE SENSITIVE MANIFOLD PAPER

This invention relates to pressure sensitive manifold paper having good color forming ability, diminished in susceptibility to color smudges due to contact or friction and outstanding in printability.

Pressure sensitive manifold papers are well known which utilize a color forming reaction between an electron donating organic chromogenic material and an electron accepting color developer. Microcapsules enclosing oily droplets with the chromogenic materials dissolved therein are used in combination with the color developer in various forms.

Typical pressure sensitive manifold paper comprises a capsule sheet prepared by coating a substrate with a composition containing microcapsules and drying the coating. Investigations are under way on encapsulating processes since the properties of the pressure sensitve manifold paper obtained are dependent largely on the characteristics of the microcapsules.

Microcapsules for pressure sensitive manifold paper have been prepared chiefly by the coacervation process using gelatin. However, the process is complex and only produces capsules of low concentration which are further unsatisfactory in stability, resistance to water and antiseptic properties. Moreover, the capsules obtained have the drawback that oily droplets are liable to spontaneously ooze out from capsules and are easily extracted with the surfactant or the like used for the process to migrate into the color developing layer and produce undesired color smudges. Accordingly various proposals have been made.

For example, capsules are proposed which are formed of a wall film of synthetic polymer such as polyurethane resin or polyurea resin prepared by the interfacial polymerization process. These capsules are more resistant to spontaneous oozing of oily droplets and have high resistance to water and heat. However, the proposed capsules have a new drawback which is attributable to the properties of the capsule wall forming material and therefore still remain to be improved.

Stated more specifically, polyurethane resin or polyurea resin is very hard and provides capsules which are excellent in resistance to heat and solvents but are difficult to rupture by writing pressure, consequently giving reduced color forming ability to the pressure sensitive manifold paper. Although it is proposed to adjust the strength of the capsule wall film by reducing its thickness or modifying the properties of the wall film to thereby assure fully useful color forming ability, these proposals involve difficulty in maintaining effective color formation in balance with prevention of color smudges, such that the wall film generally becomes excessively thin. The capsules obtained are therefore susceptible to rupture owing to contact or friction to produce undesired color smudges or exhibit impaired resistance to heat and solvents.

An object of the present invention is to provide a pressure sensitive manifold paper which is free of the foregoing drawbacks attendant on capsules formed of polyurethane resin or polyurea resin wall film.

Another object of the present invention is to provide a pressure sensitive manifold paper incorporating polyurethane or polyurea microcapsules which retain satisfactory color forming ability and are less susceptible to color smudges due to contact, friction or the like.

These objects and other features of the present invention will become apparent from the following description.

The present invention provides a pressure sensitive manifold paper prepared by coating a substrate with a coating composition containing microcapsules of polyurethane resin or polyurea resin wall film and drying the resulting coating, the pressure sensitive manifold paper being characterized in that a latex of copolymer of comonomers comprising about 10 to about 50% by weight of styrene, about 15 to about 55% by weight of butadiene, about 10 to about 40% by weight of methyl methacrylate and up to about 15% by weight of acrylonitrile is incorporate in the coating composition in an amount of about 5 to about 30% by weight (calculated as solids) based on the microcapsules (calculated as solids).

We have carried out intensive research on capsules having a wall film of polyurethane resin or polyurea resin and on pressure sensitive manifold paper prepared by using such capsules. Consequently, we have found that the pressure sensitive manifold paper which is prepared by coating a substrate with a microcapsule composition containing a latex of a copolymer having specified monomer composition and drying the coating has a good balance between color forming properties and freedom from color smudges due to contact, friction or the like, exhibits satisfactory color forming ability and is diminished in susceptibility to color smudges due to contact, friction or the like. Moreover, the present manifold paper is excellent in printability. The present invention has been accomplished based on these novel findings.

The manifold paper of the present invention has increased resistance to color smudging due to contact, friction or the like although exhibiting satisfactory color forming ability. The reason for these outstanding properties of the paper, although still remaining to be fully clarified, will presumably be as follows. When the coating composition is applied to a substrate and dried, the latex used forms a suitably flexible film which holds or adheres the capsules onto the substrate and covers the capsules. The film not only reinforces the capsule walls but also gives the particulate capsules elasticity against compression and an effect of displacement when subjected to friction.

The latex to be used in this invention is a latex of specific copolymer of comonomers which comprise about 10 to about 50% by weight of styrene, about 15 to about 55% by weight of butadiene, about 10 to about 40% by weight of methyl methacrylate and up to about 15% by weight of acrylonitrile. If the copolymer has a composition outside these ranges, the properties of the latex will not be in balance with the strength characteristics of the synthetic polymer capsule wall film, failing to achieve the effect contemplated by the present invention.

For example, the pressure sensitive manifold paper will not be resistant to friction or compression smudging if the copolymer contains less than about 10% by weight of styrene, more than about 55% by weight of butadiene, less than about 10% by weight of methyl methacrylate or more than about 15% by weight of acrylonitrile. On the other hand, reduced solvent resistance will result if the copolymer contains more than about 50% by weight of styrene, less than about 15% by weight of butadine or mor than about 40% by weight of methyl methacrylate.

Accordingly, the copolymer to be selected for use in this invention in the form of a latex have a composition within the above-specified ranges. More preferably, the copolymer comprises about 20 to about 40% by weight of styrene, about 25 to about 45% by weight of butadiene, about 15 to about 30% by weight of methyl methacrylate and about 5 to about 10% by weight of acrylonitrile as the constituent comonomers. A further improvement will then be achieved in the balance between the properties of the latex and those of the capsules.

The copolymer used in the form of a latex in the invention may optionally contain one or more additional monomers such as ethylenically unsaturated carboxylic acids including acrylic acid, methacrylic acid, crotonic acid, cinnamic acid, fumaric acid, maleic acid and itaconic acid, in an amount of less than 5% by weight, preferably about 3% or less. Incorporation of more than 5% by weight of the above-mentioned additional monomer is not desirable since the capsule coating composition tends to have an increased viscosity and tends to cause difficulty in coating operation, often failing to give uniform capsule sheet.

The process for preparing the specific copolymer latex is not limited specifically but can be any of various processes. However, generally useful is the emulsion polymerization process. Polymerization initiators, emulsifiers, molecular weight adjusting agents, etc. conventionally used in the art are suitably selected.

It is desired that the specific latex to be used in this invention has a minimum film-forming temperature of up to about room temperature, preferably about 0 to about 25° C. The minimum film-forming temperature is measured in accordance with the method described by T. F. Protzman, G. L. Brown, Journal Appl. Polymer Sci., 4, 81 (1960), and refers to the lowest temperature at which a latex, when applied to an aluminum plate having a temperature gradient and dried, can form a transparent and continuous film and does not become in the form of white powder. It is also desired that the copolymer particles in the latex obtained by polymerization have a mean particle size of about 1000 to 3000 Å, more preferably about 1500 to about 2000 Å, since if the mean particle size is less than about 1000 Å or larger than about 3000 Å, the manifold paper obtained tends to become susceptible to smudging due to friction or pressure.

If the capsule coating composition contains less than about 5% by weight of the latex (calculated as solids) based on the capsules (calculated as solids), the effect contemplated by the invention will not be available, whereas if the amount exceeds about 30% by weight, the latex will adversely affect the quality of the manifold paper obtained. It is therefore desired that the specific latex be used in an amount (calculated as solids) of about 5 to about 30% by weight, more desirably about 7 to about 20% by weight, based on the microcapsules (calculated as solids).

The process for preparing microcapsules of polyurethane resin or polyurea resin wall film for use in this invention is not limited specifically but can be any of various known processes. However, the so-called interfacial polymerization process is generally resorted to. To prepare microcapsules by the interfacial polymerization process, a hydrophobic liquid containing capsule wall forming materials and an electron donating organic chromogenic material is emulsified in a hydrophilic liquid, followed by polymerization to form a polymer at the interface and cover hydrophobic liquid droplets with the polymer.

The hydrophobic liquid usable is any of those heretofore used in the art and including, for example, cotton seed oil, hydrogenated terphenyl, hydrogenated terphenyl derivatives, alkylbiphenyl, alkylnaphthalene, diallylalkane, kerosene, paraffin, dibasic acid esters such as phthalates, and like natural and synthetic oils. These liquids are used singly or in admixture.

Examples of useful capsule wall forming materials are combinations of acid chlorides such as terephthalic acid chloride and amines such as hexamethylene diamine, and combinations of isocyanates or isothiocyanates and water, polyamines or polyols. Examples of useful isocyanates and isothiocyanates are diisocyanates and diisothiocyanates such as m-phenylene-diisocyanate, p-phenylene-diisocyanate, 2,6-tolylene-diisocyanate, 2,4-tolylene-diisocyanate, naphthalene-1,4-diisocyanate, diphenylmethane-4,4 '-diisocyanate, 3,3'-dimethoxy-4,4'-biphenyldiisocyanate, 3,3'-dimethyldiphenylmethane-4,4'-diisocyanate, xylylene-1,4-diisocyanate, xylylene-1,3-diisocyanate, 4,4'-diphenylpropane-diisocyanate, trimethylene-diisocyanate, hexamethylene-diisocyanate, lysine-diisocyanate, propylene-1,2-diisocyanate, butylene-1,2-diisocyanate, ethylidenediisocyanate, 4-isocyanatemethyl-1,8-octamethylenediisocyanate, cyclohexylene-1,2-diisocyanate, cyclohexylene-1,4-diisocyanate, isophorone-diisocyanate, 2,6-diisocyanatecaproic acid β-isocyanate ethyl ester, p-phenylene-diisothiocyanate, xylylene-1,4-diisothiocyanate, ethylidene-diisothiocyanate and the like, triisocyanates such as 4,4', 4''-triphenylmethane-triisocyanate, toluene-2,4,6-triisocyanate, and trimers of diisocyanates such as hexamethylene-diisocyanate, polyisocyanates such as polymethylenepolyphenyl-isocyanate and 4,4'-dimethyldiphenylmethane-2,2',5,5'-tetraisocyanate, and addition products of such polyisocyanates and compounds having hydrophilic groups, such as polyamines (e.g. o-phenylenediamine, 1,3-naphthylenediamine), polycarboxylic acids (e.g. pimelic acid, suberic acid, o-phthalic acid, terephthalic acid), polythiols (e.g. condensate of thioglycol), polyhydroxy compounds (e.g. trimethylolpropane, catechol, resorcin, hydroquinone), epoxy compounds (e.g. glycidyl ester, glycidyl ether) or the like. These polyisocyanate compounds are usable in various combinations such as a combination of an aromatic compound and an aliphatic compound, according to the desired quality of capsules.

The amount of the isocyanate to be added to the hydrophobic liquid is preferably about 0.02 to about 60 parts by weight, more preferably about 0.03 to about 40 parts by weight, per part by weight of the liquid.

The polyamine to be used in this invention is any of those which have at least two -NH or $-NH_2$ groups in the molecule. Examples of useful polyamines are aliphatic polyamines such as diethylenetriamine, triethylenetetramine, 1,3-propylenediamine and hexamethylenediamine; adducts of aliphatic polyamines and epoxy compounds; alicyclic polyamines such as piperazine; heterocyclic diamines such as 3,9-bis-aminopropyl-2,4,8,10-tetraoxaspiro-[5,5]undecane; etc.

Examples of useful polyols are aromatic and aliphatic polyhydric alcohols such as catechol, resorcin, hydroquinone, 1,2-dihydroxy-4-methylbenzene, 2,4-dihydroxyethylbenzene, 1,3-naphthalenediol, o,o'-biphenol, 4,4'-isopropylidenediphenol(bisphenol A), 2,2'-bis(4-hydroxyphenyl)butane, ethylene glycol, 1,3-propylene glycol, trimethylolpropane and glycerin.

The amount of the polyamine or polyol to be used is usually 0.1 to 200 parts by weight, preferably 1 to 100 parts by weight, per 100 parts by weight of the amount of the isocyanate, although suitably variable in accordance with the kind and amount of the isocyanate, etc.

Examples of useful electron donating chromogenic materials which undergo a color forming reaction with a color developer are those heretofore used and including triarylmethanelactone compounds such as 3,3-bis(p-dimethylaminophenyl)-6-dimethylaminophthalide(CVL), 3,3-bis(p-dimethylaminophenyl)phthalide, 3-(p-dimethylaminophenyl)-3-(1,2-dimethylindole-3-yl)phthalide, 3-(4-diethylamino-2-ethoxyphenyl)-3-(2-methyl-1-octyl-3-indolyl)-4-azaphthalide, 3,3-bis(2methyl -1-octyl-3-i-methylndolyl)-4-azaphthalide, etc., diphenylmethane compounds such as 4,4'-bisdimethylaminobenzhydrylbenzylether, N-halophenylleucoauramine, N-2,4,5-trichlorophenyl-leucoauramine, etc., fluoran compounds such as 7-diethylamino-3-chlorofluoran, 7-diethylamino-3-chloro-2-methylfluoran, 2-phenylamino-3-methyl-6-(N-ethyl-N-p-toluylamino)fluoran, etc., thiazine compounds such as benzoyl-leucomethyleneblue, p-nitrobenzyl-leucomethyleneblue, etc., spiro compounds such as 3-methyl-spiro-dinaphthopyran, 3-ethyl-spiro-dinaphthopyran, 3-propyl-spiro-dinaphthopyran, 3-propyl-spiro-dibenzopyran, etc., lactam compound such as rhodamine-B-anilinolactam, rhodamine-(p-nitroanilino)lactam, rhodamine-(o-chloroanilino)lactam, etc., and triarylmethane compounds such as N-butyl-3-[bis{4-(N-methylanilino)phenyl}methyl]carbazole, etc. These electron donating organic chromogenic materials are used in an amount effective for undergoing a color forming reaction with a color developer upon contact therewith when the capsules are ruptured by writing pressure.

The hydrophobic liquid having incorporated therein the desired essential components is then emulsified in a hydrophilic liquid. Hydrophilic liquids heretofore used are useful, such as aqueous solutions of polyvinyl alcohol, polyvinylbenzenesulfonic acid and copolymers thereof, homopolymer and copolymers of 2-acrylamido-2-methylpropanesulfonic acid, gelatin, gum arabic, carboxymethyl cellulose, casein and the like, or mixtures of such materials.

The polyamine or polyol, when to be used, can be made to be present in the hydrophilic liquid or the hydrophobic liquid as dissolved or dispersed therein.

The resulting emulsion is then subjected to polymerization reaction to form a polymer at the interface. The polymerization is carried out by the interfacial polymerization process which has been used for the preparation of microcapsules. Such process can be carried out under usual conditions.

It is desired that the capsules to be prepared be adjusted to a mean particle size of about 2 to about 15 μm.

As is the cas with the capsule sheets of usual pressure sensitive manifold paper, the capsule coating composition of the invention may incorporate, when desired, a stilt agent, water-soluble adhesive and various other auxiliary agents, in addition to capsules and the specified latex. Examples of useful stilt agents are starch particles, cellulose particles, particulate inorganic materials such as glass beads, etc. which are slightly larger than capsules, e.g., 2 to 6 times the capsules in particle size. The stilt agent is used in an amount of about 20 to about 150 parts by weight per 100 parts by weight of capsules calculated as solids. Examples of useful water-soluble adhesives are water-soluble high molecular weight materials such as starches (e.g. oxidized starch, esterified starch, etherified starch), polyvinyl alcohols, cellulose derivatives (e.g. hydroxyethyl cellulose, methyl cellulose, carboxymethyl cellulose) and carboxylic acid polymers (e.g. acrylic acid-acrylate copolymer salts, styrene-acrylic acid copolymer salts. Such adhesives are used in an amount of about 5 to about 50 parts by weight per 100 parts by weight of capsules calculated as solids.

Other auxiliary agents which may be used when desired are, for example, defoaming agents, waterproof agents, coloring dyes, ultraviolet absorbers, etc.

The method of preparing the coating composition is not limited specifically but may be a conventional one. The microcapsule coating composition thus prepared is applied to a surface of a substrate such as natural paper or synthetic paper using a conventional coater and then dried. There is no strict limitation for the coating amount. Usually, the coating composition may be applied to a substrate in an amount of about 1 to about 15 $g/m^2$, preferably about 2 to about 8 $g/m^2$, on dry basis.

In the pressure sensitive manifold paper which comprises a combination of a top sheet and a bottom sheet, the foregoing composition containing microcapsules is usually applied to the underside of the top sheet, and to the upper side of the bottom sheet is applied another coating composition containing an electron accepting color developer. Similarly, in the pressure sensitive manifold paper which comprises a combination of a top sheet, at least one middle sheet and a bottom sheet, the foregoing composition containing microcapsules is usually applied to the underside of each of the top sheet and the middle sheet, and to the upper side of each of the middle sheet and the bottom sheet is applied another coating composition containing an electron accepting color developer.

In another pressure sensitive manifold paper known as the "self-contained" type, both the foregoing microcapsule coating composition and the color developer coating compositon are applied to one surface of the same subtrate.

As the electron accepting color developers, there are known various finely divided inorganic acidic compounds such as acidic clay, activated clay, attapulgite, silica and aluminum silicate, various organic acidic compounds such as phenols, phenolic polymers, aromatic carboxylic acids and polyvalent metal salts thereof, e.g., as disclosed in Japanese Examined Patent Publications Nos. 10,856/1974 and 25,174/1976. The methods of preparing and applying the color developer coating compositon are well known in the art and disclosed, for example, in the above cited Japanese Examined Patent Publications. The color developer is usually used in an amount effective for reacting with the electron donating chromogenic material to form a colored image.

The present invention will be described in greater detail with reference to the following examples, to which the invention is not limited. In these examples, the parts and percentages are all by weight unless otherwise specified.

EXAMPLES 1-14 3 AND COMPARATIVE EXAMPLES 1 AND 2

(A) Preparation of dispersion of microcapsules containing chromogenic material Three parts of 3,3-bis(p-dimethylaminophenyl)-6-dimethylaminophthalide, 0.5 part of N-n-butyl-3-[bis{4-(N-methylanilino)phenyl}methyl]carbazole and 0.1 part of rhodamine-B-anilinolactam were dissolved in 100 parts of diisopropylnaphthalene. In this oily solution were dissolved 4 parts of polymethylenepolyphenylisocyanate which is an aromatic polyisocyanate ("MILLIONATE MR500," product of Nippon Polyurethane Co., Ltd.) and 8 parts of trimer of hexamethylene diisocyanate which is an aliphatic polyisocyanate having a biuret linkage.

The resulting oily solution was added to 300 parts of 2% aqueous solution of polyvinyl alcohol ("PVA117," product of Kuraray Co., Ltd.) and emulsified by a homomixer to obtain a dispersion having a mean particle size of 10 μm. To the dispersion was added 2 parts of a polyamine which is an adduct of bisphenol A, epichlorohydrin and an alkylamine. The mixture was stirred at room temperature for 15 minutes, thereafter reacted at an elevated temperature of 90° C. for 4 hours and then cooled to room temperature to obtain a dispersion of microcapsules formed mainly of polyurea and containing the chromogenic materials.

(B) Preparation of capsule sheets for pressure sensitive manifold paper

Eighty parts of wheat starch particles (stilt agent) and 50 parts of 20% aqueous solution of oxidized starch (adhesive) were added to 100 parts (calculated as solids) of the microcapsule dispersion. Further added to the dispersion was a latex of a copolymer (1500 Å in mean particle size) of 30% of styrene, 35% of butadiene, 25% of methyl methacrylate, 7% of acrylonitrile and 3% of ethylenically unsaturated carboxylic acid, in an amount (calculated as solids) of 3 parts (Comparative Example 1), 6 parts (Example 1), 10 parts (Example 2), 20 parts (Example 3) or 40 parts (Comparative Example 2). The mixture was then stirred. In this way, five kinds of capsule-containing coating compositions were prepared.

Each coating composition was applied to a substrate by an air knife coater in an amount by dry weight of 4 g/m$^2$. Thus, five kinds of capsule sheets (top sheets) for pressure sensitive manifold paper were prepared.

EXAMPLE 4 AND COMPARATIVE EXAMPLES 3-5

Four kinds of capsule sheets were prepared in the same manner as in Example 2 except that the copolymers of the latices used had the compositions listed in Table 1 below, in which styrene, butadiene, methyl methacrylate, acrylonitrile and ethylenically unsaturated carboxylic acid are represented by ST, BD, MMA, AN and EUCA, respectively.

TABLE 1

| | Composition (%) | | | | |
|---|---|---|---|---|---|
| | ST | BD | MMA | AN | EUCA |
| Example 4 | 32 | 40 | 20 | 5 | 3 |
| Comp. Ex. 3 | 15 | 60 | 22 | 0 | 3 |
| Comp. Ex. 4 | 55 | 32 | 5 | 0 | 3 |
| Comp. Ex. 5 | 25 | 50 | 5 | 20 | 0 |

The latices used were all about 1500 Å in mean particle size.

Comparative Examples 6-10

Five kinds of capsule sheets were prepared in the same manner as in Example 2 except that the copolymer latex was replaced by a latex of the vinylidene chloride, vinyl acetate, silicone, ethylene-vinyl acetate or acrylate type as mentioned below.

Comp. Ex. 6: vinylidene chloride type: ARON DX-305, product of Toagosei Chemical Industry Co., Ltd.

Comp. Ex. 7: vinyl acetate type: SEBIAN A, product of Daicel Ltd.

Comp. Ex. 8: silicone type: VONCOAT DV-759, product of Dainippon Ink & Chemicals Inc.

Comp. Ex. 9: ethylene-vinyl acetate type: OM-4000, product of Kuraray Co., Ltd.

Comp. Ex.10: acrylate type: ARONTAC A-108IH, product of Toagosei Chemical Industry Co., Ltd.

EXAMPLE 5

(A) Preparation of dispersion of microcapsules containing chromogenic material A 3.5 part quantity of 3,3-bis(p-dimethylaminophenyl)-6-dimethylaminophthalide was dissolved in 100 parts of diisopropylnaphthalene. To this oily solution were added with stirring 7 parts of adduct of tolylene diisocyanate and trimethylolpropane ("CORONATE L," product of Nippon Polyurethane Co., Ltd.), 1.5 parts of polyol ("ACTCOL 51-530," product of Takeda Chemical Industries, Ltd.) and 0.1 part of dibutyl tin dilaurate (as catalyst).

The resulting oily solution was added to 300 parts of 2% aqueous solution of polyvinyl alcohol ("PVA-217," product of Kuraray Co., Ltd.) and emulsified by a homomixer to obtain a dispersion having a mean particle size of 10 pm. To the dispersion was added 6 parts of adduct of polyamine and epoxy compound ("EPIKURE U," product of Shell Chemical Co., Ltd.). The mixture was stirred at room temperature for 15 minutes, thereafter reacted at an elevated temperature of 90° C. for 4 hours and then cooled to room temperature to obtain a dispersion of microcapsules formed mainly of polyurethane and containing the chromogenic material.

(B) Preparation of capsule sheets for pressure sensitive manifold paper

A capsule sheet (top sheet) for pressure sensitive manifold paper was prepared in the same manner as in Example 2 except that 100 parts (calculated as solids) of the dispersion of microcapsules prepared in (A) above was used.

Comparative Examples 11-15

Five kinds of capsule sheets were prepared in the same manner as in Example 5 except that the copolymer latex was replaced by a latex of the vinylidene chloride type (ARON DX-305, Comp. Ex.11), of the vinyl acetate type (SEBIAN A, Comp. Ex.12), of the silicone type (VONCOAT DV-759, Comp. Ex. 13), of the ethylene-vinyl acetate type (OM-4000, Comp. Ex 14) or of the acrylate type (ARONTAC A-108IH, Comp. Ex. 15).

The twenty kinds of capsule sheets (top sheets) thus prepared for providing pressure sensitive manifold paper were tested for properties by the methods given below using the following color developer sheet. Table 2 shows the results.

Preparation of color developer sheets for pressure sensitive manifold paper

Aluminum hydroxide (65 parts), 20 parts of zinc oxide, 15 parts of a molten mixture of zinc 3,5-di(α-methylbenzyl)salicylate and α-methylstyrene-styrene copolymer (in a mixing ratio of 80/20), 5 parts (calculated as solids) of aqueous solution of polyvinyl alcohol and 300 parts of water were treated in a ball mill for 24 hours to obtain a dispersion, to which 20 parts (solids) of a carboxy-modified styrene-butadiene copolymer latex was added to obtain a color developer coating composition. The composition was applied to substrates in an amount by dry weight of 5 g/m$^2$ to prepare color developer sheets (bottom sheets) for pressure sensitive manifold paper.

Test methods (1) Color forming ability

The top sheet was superposed on the bottom sheet with their coated surfaces opposed to each other, and the sheets were passed through a super calender for color formation. One hour thereafter, the density of the color was measured by a Macbeth densitometer. (The higher the value, the better is the color forming ability.)

(2) Resistance to friction

The top sheet was superposed on the bottom sheet with their coated surfaces opposed to each other, the sheets were then rubbed against each other five times while being subjected to a load of 4 kg/cm$^2$, and the degree of color smudge on the color developer coating was determined with the eyes according to the following criteria.

A: almost free of any smudge.

B: slightly smudged but satisfactory to use.

C: markedly smudged and unfit to use.

(3) Resistance to heat

The top sheet was superposed on the bottom sheet with their coated surfaces opposed to each other, the sheets were then heat-treated at 120° C. for 3 hours while being subjected to a load of 5 kg/cm$^2$, and the color density of the developer coating was measured by a Macbeth densitometer (The smaller the value, the better is the heat resistance.)

(4) Resistance to solvents

The top sheet was allowed to stand in an atmosphere saturated with trichloroethylene at room temperature for 8 hours. The sheet was thereafter superposed on the bottom sheet with their coated surfaces opposed to each other, the sheets were passed through a super calender for color formation. The density of the color was measured by a Macbeth densitometer one hour later. (The value should be compared with the value of the color forming ability under the item (1). The smaller the difference, the higher is the solvent resistance.)

TABLE 2

| | Color forming ability | Resistance to: | | |
|---|---|---|---|---|
| | | Friction | Heat | Solvents |
| Comp. Ex. 1 | 0.71 | C | 0.06 | 0.58 |
| Example 1 | 0.72 | B | 0.06 | 0.59 |
| Example 2 | 0.73 | A | 0.07 | 0.58 |
| Example 3 | 0.72 | A | 0.08 | 0.59 |
| Comp. Ex. 2 | 0.60 | A | 0.20 | 0.25 |
| Example 4 | 0.72 | A | 0.06 | 0.58 |
| Comp. Ex. 3 | 0.72 | C | 0.06 | 0.59 |
| Comp. Ex. 4 | 0.71 | B | 0.07 | 0.21 |
| Comp. Ex. 5 | 0.71 | C | 0.06 | 0.57 |

TABLE 2-continued

| | Color forming ability | Resistance to: | | |
|---|---|---|---|---|
| | | Friction | Heat | Solvents |
| Comp. Ex. 6 | 0.67 | C | 0.05 | 0.20 |
| Comp. Ex. 7 | 0.70 | C | 0.05 | 0.24 |
| Comp. Ex. 8 | 0.50 | B | 0.05 | 0.15 |
| Comp. Ex. 9 | 0.72 | C | 0.07 | 0.50 |
| Comp. Ex. 10 | 0.70 | C | 0.20 | 0.25 |
| Example 5 | 0.75 | A | 0.05 | 0.60 |
| Comp. Ex. 11 | 0.65 | C | 0.05 | 0.15 |
| Comp. Ex. 12 | 0.72 | C | 0.06 | 0.20 |
| Comp. Ex. 13 | 0.50 | B | 0.07 | 0.15 |
| Comp. Ex. 14 | 0.73 | C | 0.05 | 0.50 |
| Comp. Ex. 15 | 0.70 | C | 0.25 | 0.20 |

As seen from Table 2, the pressure sensitive manifold papers of the invention comprising a capsule sheet prepared by coating a substrate with a coating compositon containing microcapsules of polyurethane or polyurea resin wall film and a specified amount of the specific copolymer latex are each excellent in color forming ability, resisitance to friction, resistance to heat and resistance to solvents, and maintain an adequate balance between the color forming ability and susceptibility to color smudges due to friction.

What is claimed is:

1. A pressure sensitive manifold paper prepared by coating a substrate with a coating composition containing microcapsules of polyurethane resin or polyurea resin wall film and drying the resulting coating, the pressure sensitive manifold paper being characterized in that a latex of copolymer of comonomers comprising about 20% to about 40% by weight of styrene, about 25% to about 45% by weight of butadiene, about 15% to about 30% by weight of methyl methacrylate and about 5% to about 10% by weight of acrylonitrile is incorporated in the coating composition in an amount of about 5% to about 30% by weight (calculated as solids) based on the microcapsules (calculated as solids), wherein said microcapsules enclose chromogenic materials.

2. A pressure sensitive manifold paper as defined in claim 1 wherein the latex has minimum film-forming temperature of up to about room temperature.

3. A pressure sensitive manifold paper as defined in claim 1 wherein the copolymer is about 1000 to about 3000 Å in mean particle size.

4. pressure sensitive manifold paper as defined in claim 1 wherein the latex is used in an amount of 7 to 20% by weight calculated as solids based on the amount of microcapsules (calculated as solids).

5. A pressure sensitive manifold paper as defined in claim 1 wherein the coating composition further comprises a stilt agent.

6. A pressure sensitive manifold paper as defined in claim 5 wherein the stilt agent is a particulate starch, particulate cellulose or finely divided inorganic material.

7. A pressure sensitive manifold paper as defined in claim 5 wherein the stilt agent is used in an amount of about 20 to about 150 parts by weight per 100 parts by weight of microcapsules (calculated as solids).

8. A pressure sensitive manifold paper as defined in claim 1 wherein the coating composition further comprises a water-soluble adhesive.

9. pressure sensitive manifold paper as defined in claim 8 wherein the water-soluble adhesive is a water-soluble high molecular weight substance selected from the group consisting of starches, polyvinyl alcohols, cellulose derivatives and carboxylic acid polymers.

10. A pressure sensitive manifold paper as defined in claim, 8 wherein the water-soluble adhesive is used in an amount of about 5 to about 50 parts by weight per 100 parts by weight of microcapsules (calculated as solids).

* * * * *